US007373762B2

(12) United States Patent
Hubbard

(10) Patent No.: US 7,373,762 B2
(45) Date of Patent: May 20, 2008

(54) MULTI-FUNCTIONAL ASSEMBLY INCLUDING A PANEL AND STUD WITH OPPOSITELY CONFIGURED "V" NOTCHES ALONG A CROSS SECTIONAL CONFIGURATION

(76) Inventor: Richard L. Hubbard, 11191 Rivendall Ct., Pinckney, MI (US) 48169

( * ) Notice: Subject to any disclaimer, the term of this patent is extended or adjusted under 35 U.S.C. 154(b) by 692 days.

(21) Appl. No.: 10/840,523

(22) Filed: May 6, 2004

(65) Prior Publication Data

US 2005/0102920 A1 May 19, 2005

Related U.S. Application Data

(60) Provisional application No. 60/475,152, filed on Jun. 2, 2003.

(51) Int. Cl.
*E04B 1/00* (2006.01)
*E04B 1/61* (2006.01)
*E04C 2/32* (2006.01)

(52) U.S. Cl. ..... 52/281; 52/282.1; 52/459; 52/464; 52/481.1; 52/762; 52/764; 52/775; 52/800.1; 52/800.12; 52/800.18; 52/801.1; 52/802.1

(58) Field of Classification Search ..... 52/236.6, 52/242, 281, 282.1, 459, 464, 481.1, 762, 52/764, 775, 800.1, 800.12, 800.18, 801.1, 52/802.1, 702, 703
See application file for complete search history.

(56) References Cited

U.S. PATENT DOCUMENTS 3,470,665 A * 10/1969 Perrault ..... 52/278
3,851,372 A 12/1974 Wirch ..... 29/428
4,383,397 A * 5/1983 Ward ..... 403/231
4,854,096 A 8/1989 Smolik ..... 52/241
5,065,558 A * 11/1991 Boatsman ..... 52/239
5,321,924 A * 6/1994 Smolik ..... 52/204.1
5,642,594 A * 7/1997 Sucre F ..... 52/270
5,848,508 A * 12/1998 Albrecht ..... 52/309.9
5,896,717 A * 4/1999 Gill ..... 52/586.2
6,006,480 A * 12/1999 Rook ..... 52/309.12
6,016,632 A 1/2000 Mc Gee ..... 52/241
6,209,282 B1 * 4/2001 Lafrance ..... 52/729.1
6,976,337 B2 * 12/2005 Hiraki ..... 52/79.1
2002/0166302 A1 * 11/2002 Ogorchock ..... 52/294
2004/0118063 A1 * 6/2004 Shidler ..... 52/309.11

* cited by examiner

*Primary Examiner*—Richard E. Chilcot, Jr.
*Assistant Examiner*—Branon C Painter
(74) *Attorney, Agent, or Firm*—Gifford, Krass, Sprinkle, Anderson & Citkowski, P.C.

(57) ABSTRACT

A multi-functional building assembly includes a plurality of elongated studs, each of the studs including a recessed notch defined in axially extending fashion along first and second opposite extending surfaces. A plurality of elongated and planar shaped panels include extending edges which match in configuration that of each of the notches and in order that a selected panel is secured to a selected stud. A plurality of the studs and panels are engaged in end-to-end extending fashion to construct at least one of a wall and a corner detail.

18 Claims, 7 Drawing Sheets

MULTI-FUNCTIONAL ASSEMBLY INCLUDING A PANEL AND STUD WITH OPPOSITELY CONFIGURED "V" NOTCHES ALONG A CROSS SECTIONAL CONFIGURATION

CROSS REFERENCE TO RELATED APPLICATIONS

The present application claims the priority of U.S. Provisional Application Ser. No. 60/475,152 filed Jun. 2, 2003 and entitled multi-functional assembly including a panel and stud with oppositely configured "V" notches along a cross sectional configuration.

BACKGROUND OF THE INVENTION

1. Field of the Invention

The present invention relates generally to framing members or studs used in building construction. More particularly, the present invention discloses a multi-functional building panel and stud arrangement, the stud exhibiting in cross section a pair of oppositely facing and substantially "V" shaped notches defined therein, and which functions in any one of a variety of different construction applications.

2. Description of the Prior Art

The prior art is well documented with many examples of framing construction assemblies and for the purpose of facilitating construction of building walls and the like. A first example of the prior art is set forth in U.S. Pat. No. 3,851,372, issued to Wirch, and which teaches a method of framing is construction including pre-mortising a group of elongated beams to be used as plate material by forming notches across the width of each of the beams at longitudinally spaced apart locations along the length of each beam. A framed wall panel is formed by arranging the pre-mortised beams to provide a bottom plate of the wall panel, and an upper plate of the wall panel spaced from and extending generally parallel to the bottom plate, with the notches of the upper plate being aligned longitudinally with the notches of the bottom plate. The ends of a series of studs are placed in the aligned notches, and the ends of the studs are fastened to the notched portions of the plates to form a rigid framed wall panel in which the studs extend vertically between the bottom plate and upper plate when the panel is fastened in an upright position to provide the wall framing for the building.

U.S. Pat. No. 4,854,096, issued to Smolik, teaches a wall assembly including a plurality of generally upright wall studs in assembled relationship to lower and upper generally horizontal support beams. The wall studs can be of the metal variety and have a generally C-shaped profile with a channel located opposite a major side member of the wall stud. The support beams are channel-shaped and have parallel spaced-apart flanges extending inwardly from side walls forming a channel. The flanges have pairs of opposing notches which form pockets having a profile corresponding partially to the profile of the upright wall stud whereby the wall stud is insertable in the channel of the support beam and can be twisted to an extent where the wall stud snaps into place with respect to the pocket formed by a pair of notches with the cross-sectional length of the wall stud in transverse alignment with the longitudinal axis of the support beam. Wallboard is installed on the framework to complete the wall structure.

Finally, U.S. Pat. No. 6,016,632, issued to McGee, teaches a modular wall system having a framing assembly supporting a plurality of wall panels. The framing assembly includes top members, bottom members, and studs extending between the top and bottom members for supporting the wall panels. Each stud has a generally rectangular cross section with a front face, a back face, and left and right side faces. The front face has a recess therein with a longitudinally extending ridged trough therein for receiving threaded fasteners. The back face has an outwardly-opening generally C-shaped channel with a longitudinally extending ridged trough therein for receiving threaded fasteners. Each side face has a generally centrally located, longitudinally extending groove with a ridged trough in the groove for receiving threaded fasteners, at least one longitudinally extending gasket to seal against the edge of a panel mounted on the side of the stud, and an insert mounting slot between the groove and each gasket mounting slot; and a cover strip mounted over the front face of the stud, the cover strip having a generally "T" shaped cross section adapted to interfit with the front face of the stud with the stem of the "T" fitting in the recess in the front face, and the arms of the "T" extending laterally beyond the side edges of the front face to overlap side margins of the front face of a panel mounted on the side of the stud, and a plurality of threaded fasteners extending through the stem of the "T" shaped cross section of the cover and into the ridged trough in the front face of the stud.

SUMMARY OF THE PRESENT INVENTION

The present invention discloses a multi-functional building assembly for constructing interconnecting walls incorporated into a building structure. A plurality of elongated studs are provided, each of which includes a recessed notch defined in axially extending fashion along at least one of first and second opposite extending surfaces thereof.

A plurality of elongated and planar shaped panels are provided, each of which including opposite extending edges which match in configuration that of the notch and in order that a selected panel is secured to a selected stud. A plurality of the studs and panels are engaged in end-to-end extending fashion to construct at least one of a wall and a corner detail.

In a preferred variant, a bottom plate supports a corresponding bottom extending edge of the studs and elongated shaped and interconnected panels. In a further variant, a floor-supporting hanger secures the bottom extending edge of said panels. Provision is also made for an insulating layer of material, such as a laminated rigid foam, to be applied over a selected face of the interconnected panels.

BRIEF DESCRIPTION OF THE DRAWINGS

Reference will now be made to the attached drawings, when read in combination with the following detailed description, wherein like reference numerals refer to like parts throughout the several views, and in which.

DESCRIPTION OF THE PREFERRED EMBODIMENTS

Figure 1:
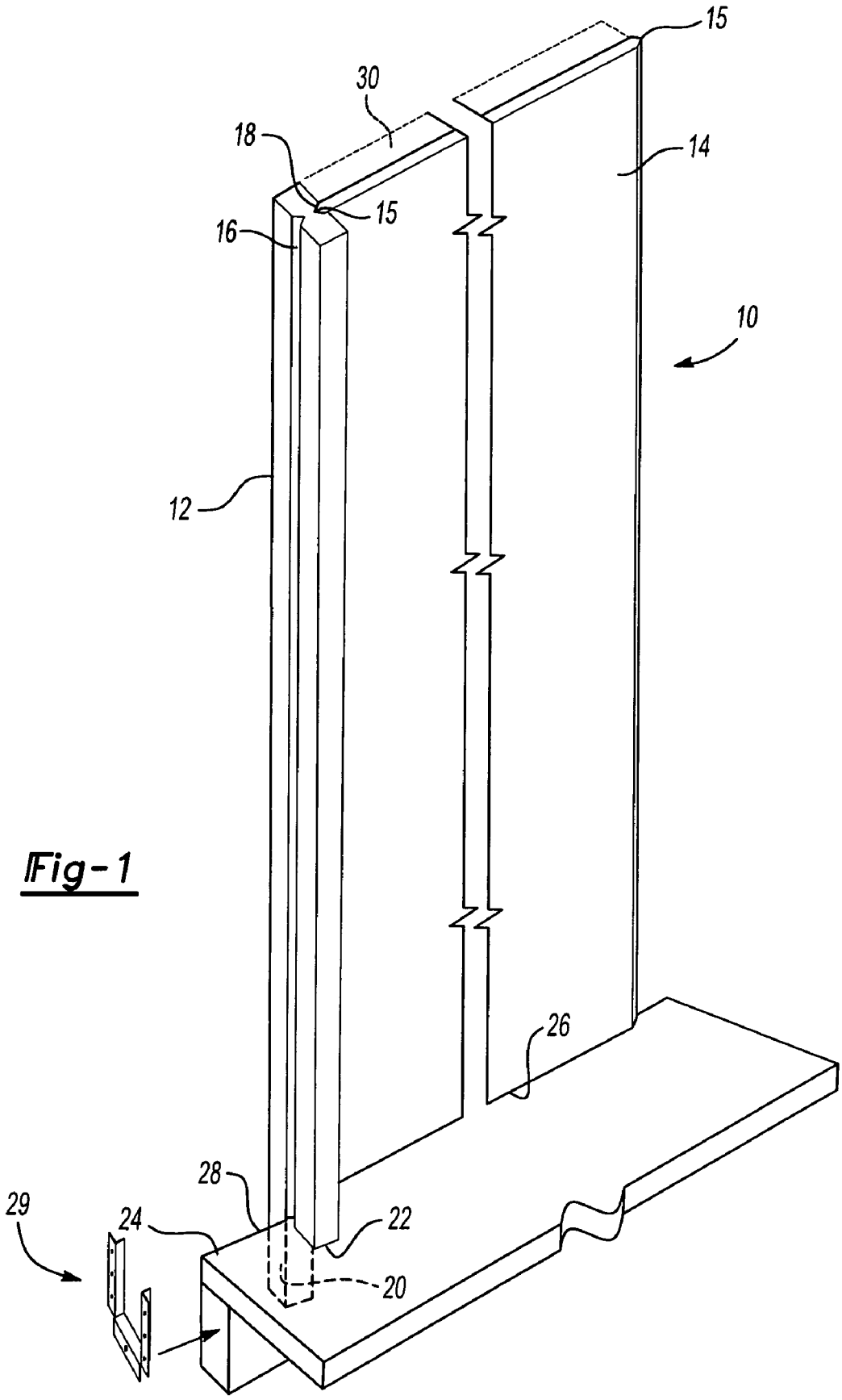
FIG. 1 is a perspective view of the building stud and panel arrangement according to a preferred embodiment of the present invention.

Referring now to FIG. 1, a perspective illustration is given generally at 10 of a building stud 12 and panel 14 arrangement according to a first preferred embodiment of the present invention. The core feature of the present invention, and in accordance with the several configurations to be subsequently described, is the provision of the elongated stud 12, and which includes a four-sided configuration as shown and by which at least one, and typically a pair, of elongated and "V" shaped notches 16 and 18 are defined in axially extending fashion and within each of opposite facing sides of the stud 12.

The stud 12 is constructed of any suitable material and such as is typically a 2×4 or 2×6 cross sectional component. The stud 12 may, in additional preferred variants, be constructed of such as a plasticized resin, a metal (aluminum), or even a synthetic wood composite.

The notches 16 and 18 are again illustrated in a substantially "V" shaped configuration and extend the substantial axial length of the stud 12. Although preferably illustrated in a "V" shaped configuration, it is also understood that other recessed shaped configurations may be utilized, without limitation, in the stud design according to the present invention.

The panel 14 includes, as is illustrated, a substantially thin and elongate shape and terminates, along opposite extending side edges, in pointed (again substantially "V" shaped) projections 15 which respectively seat within an associated "V" shaped recess corresponding to a given stud surface. The panel 14 again may exhibit any desired thickness, size and edge configuration consistent with the recessed groove defined in the stud 12, and the panel may further be constructed of any suitable building material such as a wallboard, wood or other synthetic material.

It is also envisioned that mechanical fasteners, such as nails or screws, can be applied for securing the extending ends 15 of the panels 14 within their associated stud recesses (again 16 and 18). As will be also subsequently described, it is envisioned that additional components can be utilized with nails or screws, and applied in an angular fashion within a proximate edge location of either the stud or panel to facilitate the creation of a secure wall structure. Furthermore, it is understood and envisioned that adhesives or other suitable fasteners can be employed for securing the studs and panels together.

As further shown in the arrangement of FIG. 1, the selected illustrated stud 12 is modified to include a downwardly extending (typically 2×2 or 2×4) portion 20 and an upwardly positioned bottom seating surface 22. The purpose for this is to support the stud 12 and panel 14 upon an upper facing surface 24 of a bottom joist support. As is further best shown in 1, a portion of the lower extending edge, see at 26, of the wallboard or suitable panel 14, is supported upon and along an extending edge 28 of the joist support. A joist hanger 29 is provided for securing the bottom associated edge of the stud 12 upon surface 24 of the bottom joist support. An insulation layer 30 is provided, secured against a selected (typically inner) surface of the panel 14.

Figure 7:
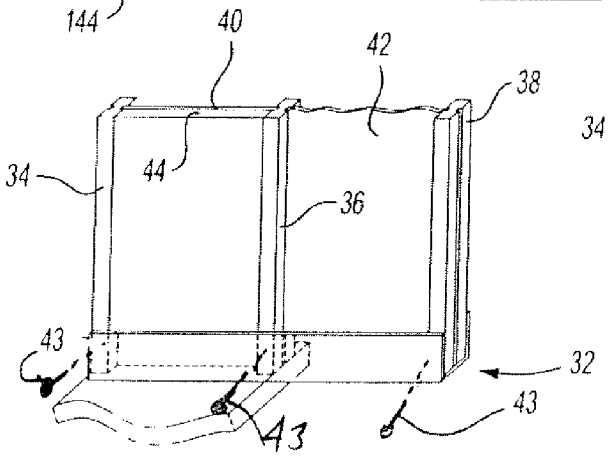
FIG. 7 is a sectional illustration of a base nailer component for use with the wall stud and panel arrangement according to the invention.

An added feature of the design of FIG. 1 is the ability to utilize only a single top extending plate, and as opposed to a double plate which is typically required for many prior art installations. Referring to FIG. 7, a sectional illustration is shown at 32 of a base nailer component for use with a wall stud and panel arrangement, generally identified by studs 34, 36 and 38 and interconnecting panels 40 and 42.

Nails or screws 43 may be applied through locations (such as apertured, recessed or notched) along the length of the base nailer 32 and in order that inserting ends of the studs and panels seat therein. The construction of the base nailer 32 further allows space for attachment of insulation panels (see as shown at 44).

As is also known, a top plate utilized in this fashion may include a notch formed therein for tying together succeeding wall panels, as well as creating an air seal. This design also eliminates the bottom plate in many applications, resulting in significant material savings. Although not further shown, it is understood that additional extending and interconnecting studs can be located at such as at 16", 24", 32" et seq. on center locations and, in combination with a plurality of panels 14, to establish an overall wall construction.

Figure 7A:
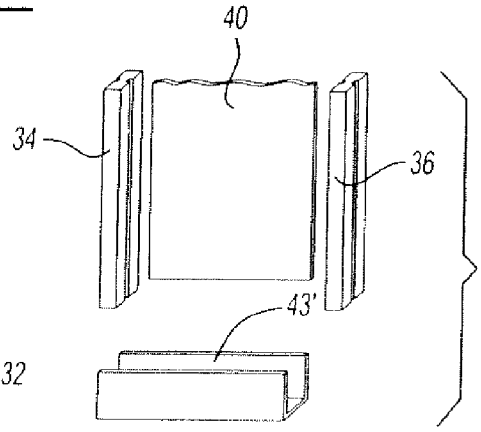
FIGS. 7A and 7B illustrate both "U" and "L" shaped bottom edge nailer in use with an interconnecting panel and as shown in exploded fashion in FIG. 7.
Figure 7B:
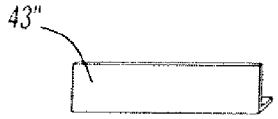

Referring to FIG. 7A, a preferred arrangement includes a base nailer 43' in reduced cross sectional dimension, and which seats between studs 34 and 36. The purpose of the nailer 43', in this variant, is not to secure the bottom ends of the studs, rather only to provide engagement to a bottom extending edge of the dry wall panel 40. As further referenced in FIG. 7B, the "U" shaped nailer can be substituted by an "L" shaped or other suitable configured bracket 43" for providing a secure nailing (or screwing) edge to the drywall panel.

Figure 2:
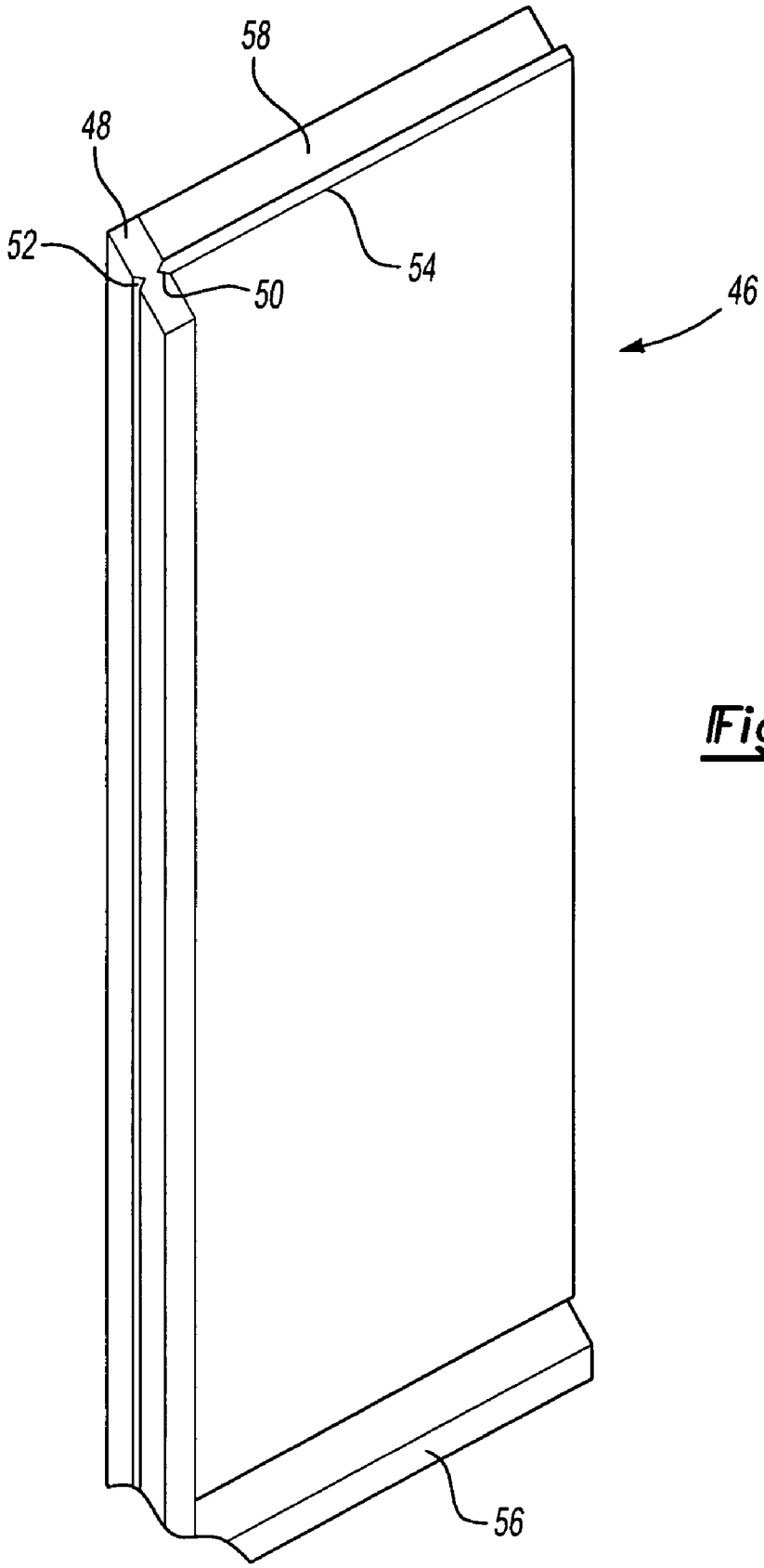
FIG. 2 is a perspective view of a stud and panel arrangement according to a further preferred embodiment and illustrating an outer panel insulating layer in combination with a bottom plate suitable for standard framing on top of deck or garage and slab applications.

Referring now to FIG. 2, a perspective view is illustrated at 46 a further floor-supporting configuration employing the building panel according to the present invention. The illustration of FIG. 2 substantially shows a stud 48 (see also recessed notches 50 and 52) as well as a panel 54, an extending side edge of which seats within a corresponding notch 50. A bottom plate 56 supports the stud and panel in a conventional framing arrangement and such as which is supported upon a garage or slab floor. An insulating layer is again illustrated at 58 secured to a selected facing surface of the panel 54 and can include such as a laminated rigid foam.

Figure 3:
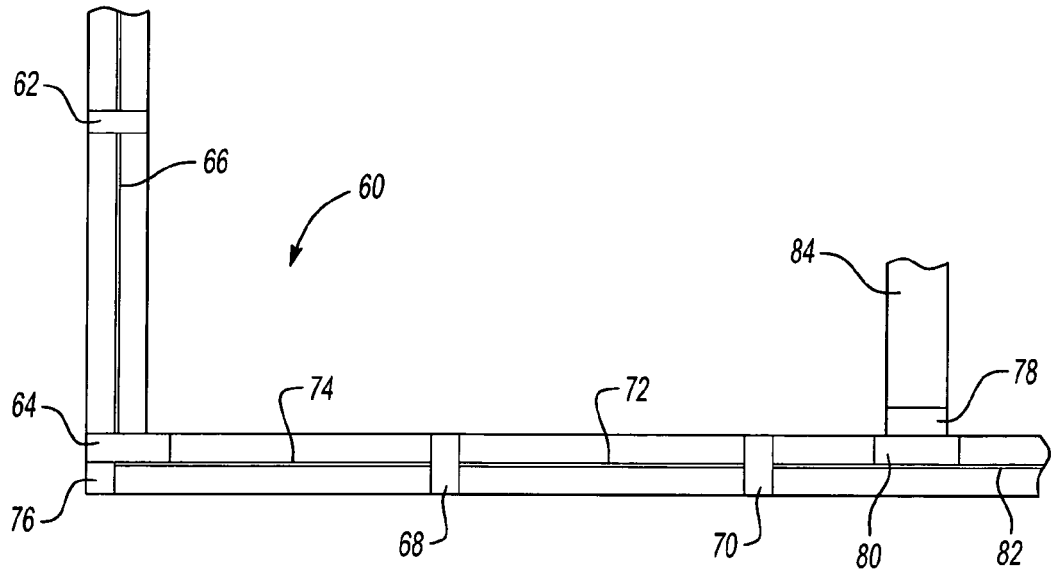
FIG. 3 is a downward looking corner and wall detail view of a 2×4 wall construction according to the present invention.
Figure 4:
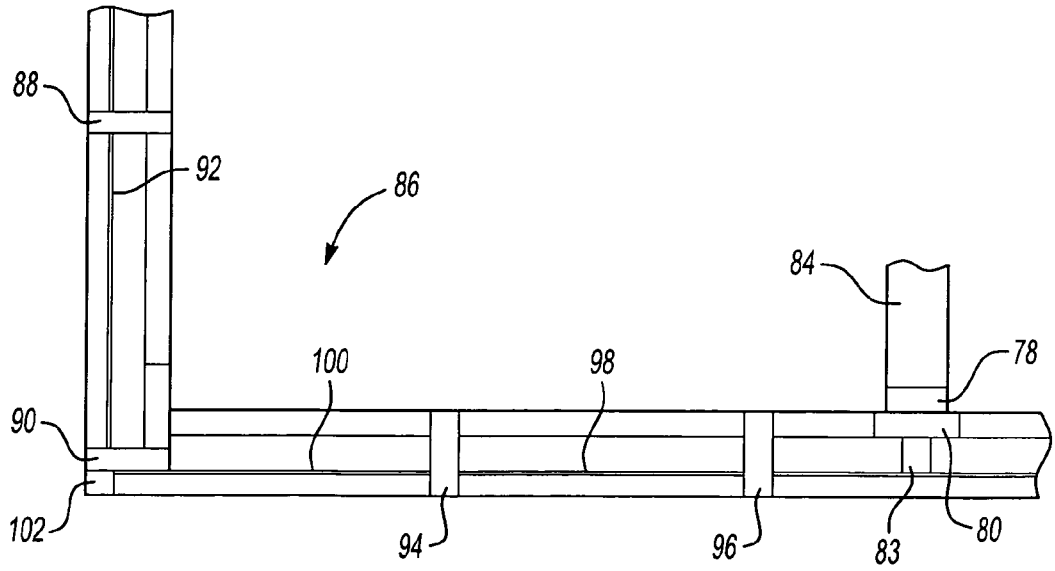
FIG. 4 is a corresponding downward looking corner and wall detail view of a 2×6 wall construction.

FIGS. 3 and 4 illustrate downward looking (cutaway) corner and wall detail views of both 2×4 (FIG. 3) and 2×6 (FIG. 4) wall constructions according to preferred variants of the present invention. In the instance of FIG. 3, a corner framework construction 60 is evidenced by 2×4 stud 62 and 2×6 stud 64 defining one wall edge and interconnected by panel 66.

A ninety degree angled wall is defined, in part, by 2×4 studs 68 and 70 separated by panels 72 and 74. A corner nailer 76 (such as a 1.5×2" item) is secured against a corner edge location of the 2×6 stud 64, and such that a smooth wall edge symmetry is maintained. An intersecting wall arrangement is further referenced by 2×4 stud 78 (seating against a 2×6 member 80 in turn secured against a surface of panel 82) and from which extends intersecting wall 84.

With further reference to FIG. 4, a corner framework construction 86 and is evidenced by 2×6 stud 88 and 2×6 stud 90 defining one wall edge and interconnected by panel 92. A ninety degree angled wall is defined, in part, by 2×6 studs 94 and 96 separated by panels 98 and 100 as well as stud 83 supporting member 80. A corner nailer 102 (such as in this case being again a 1.5×2" item) is secured against a corner edge location of the 2×6 stud 90, and such that a smooth wall edge symmetry is maintained. As with the embodiment of FIG. 3, an intersecting wall arrangement is further referenced by 2×4 stud 78 (seating against a 2×6 member 80 in turn secured against a surface of panel 82 and supported by a 1.5×2" backing) and from which extends intersecting wall 84.

Figure 5:
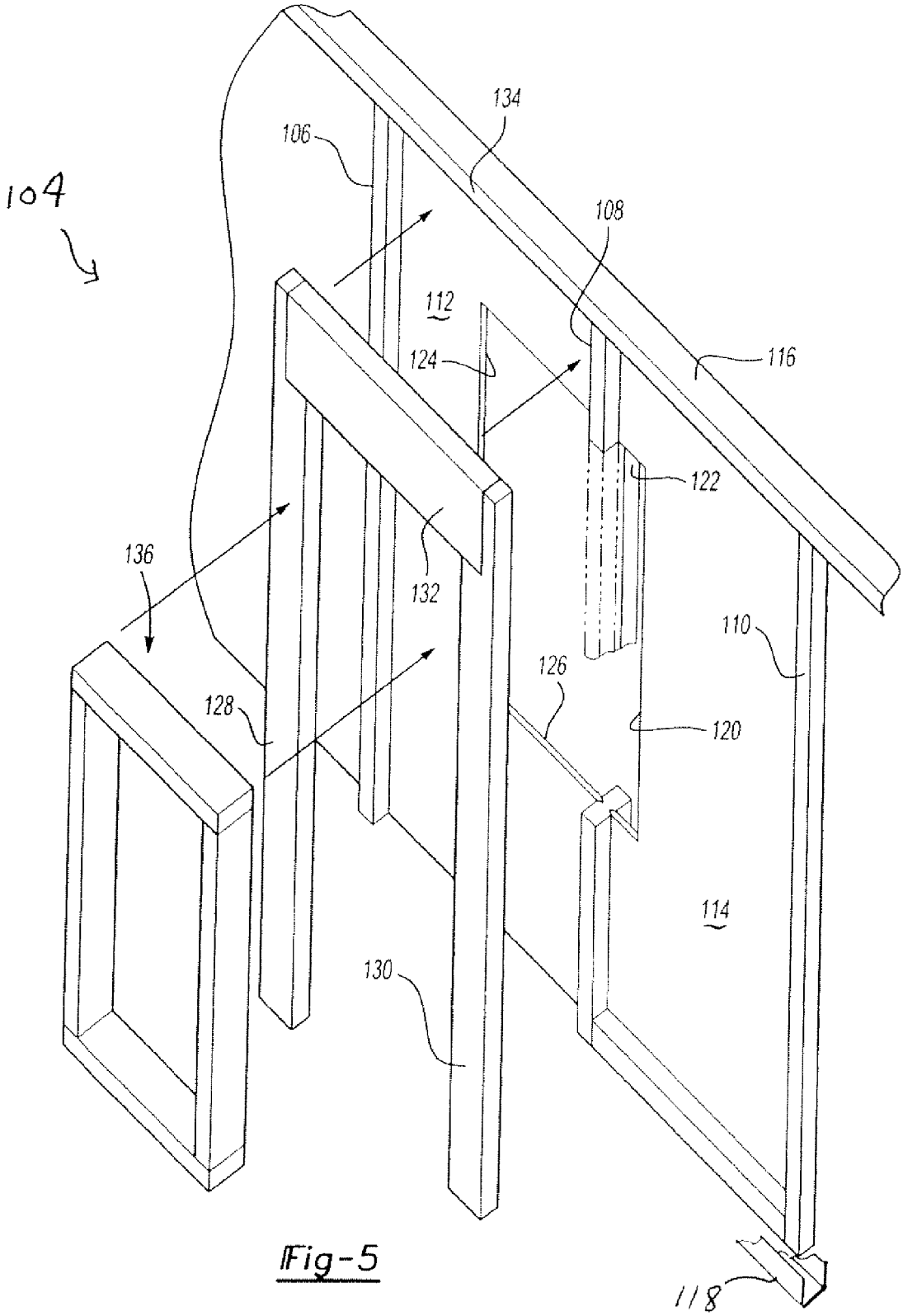
FIG. 5 is an exploded view of a window frame construction incorporated into a wall location associated with the building stud and panel according to the present invention.

Referring now to FIG. 5, an exploded illustration is shown of a window frame construction 104 incorporated into wall location associated with the building stud and panel according to the present invention. A base frame structure is illustrated, such as which is referenced by vertically extending studs 106, 108 and 110 and interconnecting panels 112 and 114. A top plate 116 is supported in horizontally extending fashion upon associated ends of the studs and panels (such as by nailing or the like) and a base nailer 118 (such as previously described at 43' in FIG. 7A) supports the corresponding bottom edges of the studs and panels.

In a first construction step, a rough dimension opening is measured and cut in the wall, and such as which is referenced by inner facing and rectangular surfaces 120, 122, 124 and 126. Of note, portions of the panels 112 and 114 are removed while temporarily leaving in place the vertically extending support 108 to maintain the structural integrity of the wall.

A substantially "U" shaped header and support is referenced by vertically extending members 128 and 130, and interconnecting top cross brace 132. The "U" shaped support is secured against a facing surface of the wall construction and in particular against an abutting edge 134 of the top plate 116.

In a further assembly step, a frame 136 (such as in this example being a four sided and window frame constructed by interconnected 2×4 members) is seated between the extending members 128 and 130 and cross brace 132 and nailed (or otherwise screwed) into place. At this point, the window (or in an alternate embodiment door) frame opening is supported and the portion of the stud 108 extending into the opening may now be removed.

Figure 6:
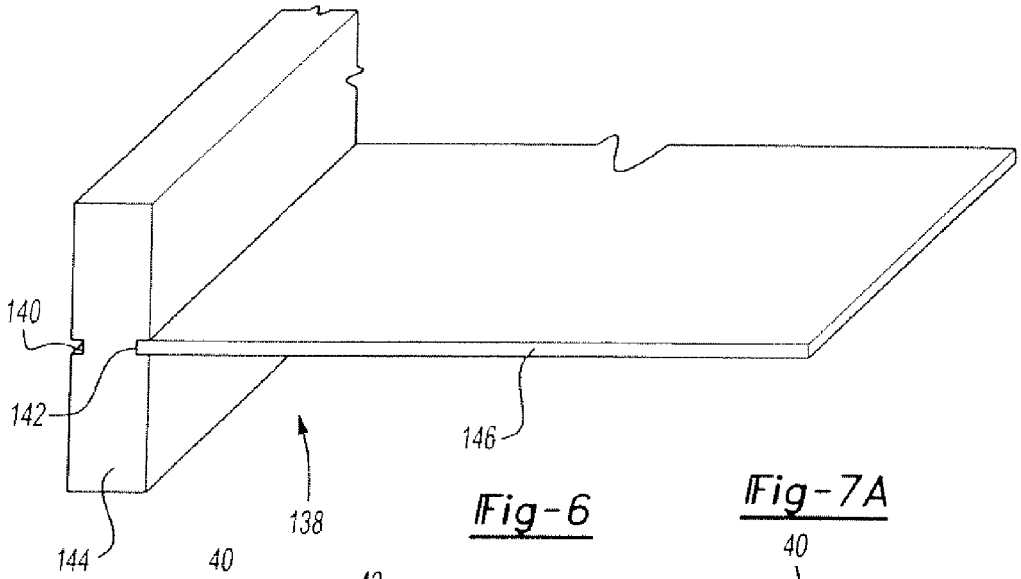
FIG. 6 is a sectional view of a stud and panel arrangement according to a further preferred embodiment and illustrating a substantially "square" cross sectional shaped recess formed in extending fashion along the wall stud and for receiving the inserted panel.

Referring now to FIG. 6, an illustration is shown at 138 of a substantially "square" cross sectional shaped recess (see at 140 and 142) formed in extending fashion along oppositely facing edges of a wall stud 144, and for receiving inserted panels, such as further referenced by panel 146 seated in recess 142. As previously described, the shape of the notches or recess, can vary from "V" to "U" shaped or other suitable shaped configurations, including arcuate (i.e., semi-circular) or the like. Additionally, the building component illustrated in FIG. 6 can further be employed in floor joist, ceiling rafter and wall panel applications within the scope of the present invention.

Figure 8:
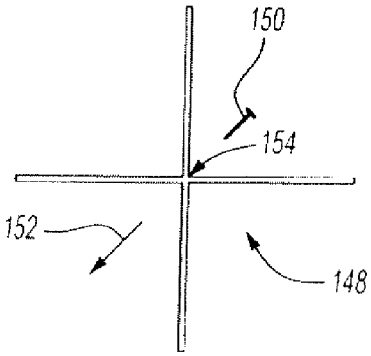
FIG. 8 is an end view of an elongated and "X" cross sectional shaped drywall corner backer and which is applied against inside corners of a 2×4 according to the present invention.
Figure 8A:
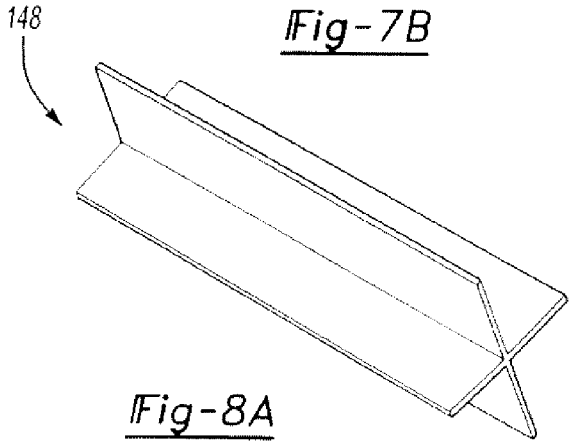
FIG. 8A is a perspective illustration of the drywall corner backer shown in FIG. 8.

Referring now to FIGS. 8 and 8A, succeeding end and partial perspective views are shown of an elongated and "X" cross sectional shaped drywall corner backer 148, and which is applied against inside corners of a 2×4 (not shown) according to the present invention. As best shown in FIG. 8, a nail 150 (or like screw fastener) is applied at an angle (see directional arrow 152) through a center web portion 154 of the corner backer 148 and in order to provide a lip edge for supporting a corresponding extending edge of such as a drywall/wallboard material.

Figure 9:
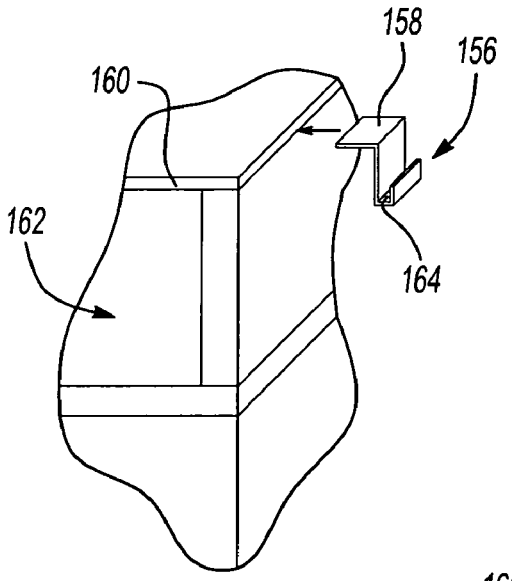
FIG. 9 is an environmental illustration of a metal panel hanger in use with the present invention and for supporting a lower extending edge of the panel.

Referring now to FIG. 9, an environmental illustration is made of a metal panel hanger 156 in use with the present invention and for supporting a lower extending edge of one or more panels (not shown). A side extending edge portion 158 of the hanger seats between succeeding layers of a plywood sheeting 160 and an extending and foundation supported bond support member 162. A curled and substantially "U" shaped edge 164 extending from the side extending edge portion 158 in turn supports the bottom extending edge of the associated panel(s) in use.

Figure 10:
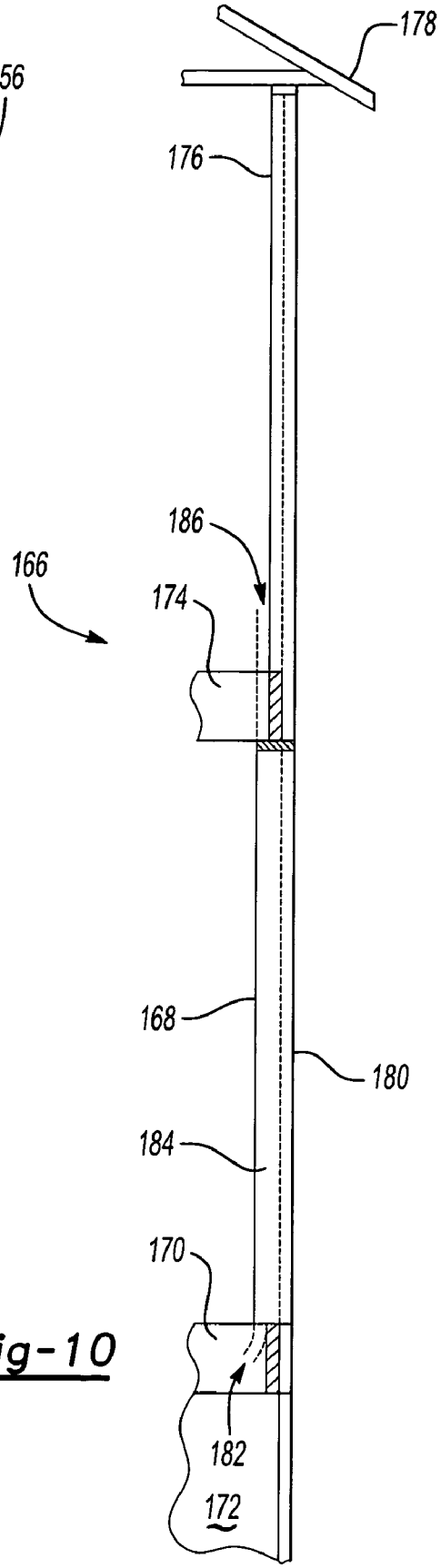
FIG. 10 is a cutaway illustration of a two-story building wall configuration employing successive 2×6 and 2×4 stud and panel arrangements, in combination with heat distribution channels according to the present invention.

Referring to FIG. 10, a cutaway illustration is shown at 166 of a two-story building wall configuration employing successive 2×6 and 2×4 stud and panel arrangements, in combination with heat distribution channels according to the present invention. In particular, a lower floor (typically 2×6) wall 168 is supported upon a floor joist 170, in turn supported upon a foundation 172.

A succeeding and intermediate joist 174 is supported upon a top edge of the stud and panel arrangement 168 and in turn supports a 2×4 wall 176, upon which is secured a roof truss 178. Additional components include an outer foam insulation layer 180, as well as an interiorly extending communication heat network for providing heat (or alternatively air conditioning) at selected locations. A lower heat run is identified at 182 and which communicates through an interior cavity 184 to such as a surface mounted heat duct 186 located at an upper floor position of the intermediate joist 174. It is also understood that the present invention can accommodate the communication of electrical and plumbing lines, in addition to the heat duct arrangement illustrated.

Figure 11:
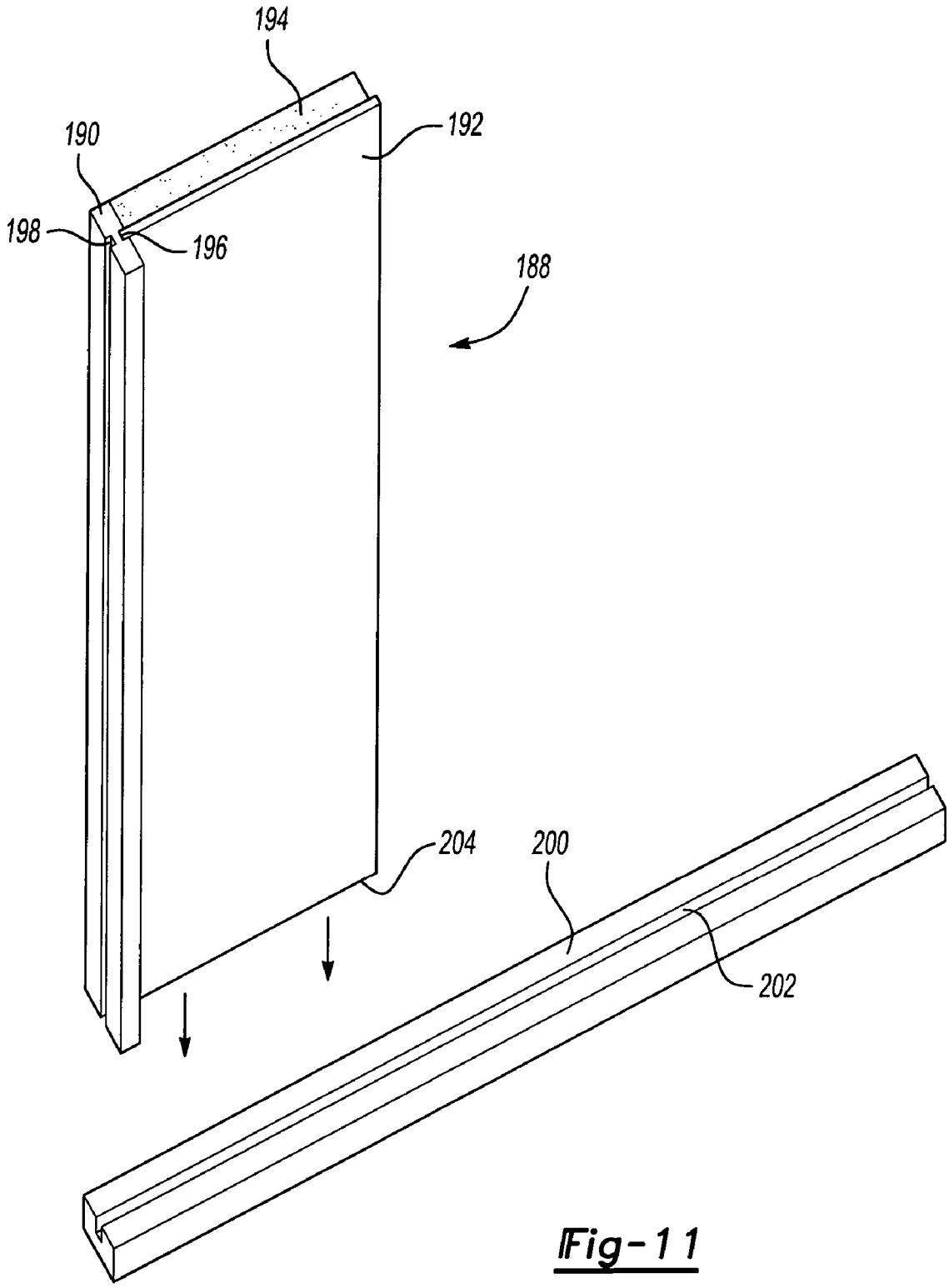
FIG. 11 is an exploded view of a yet further alternate panel and stud arrangement and by which a channel bottom plate is provided for securing an associated bottom edge of the panel.

Referring finally to FIG. 11, an exploded view is illustrated at 188 of a yet further configuration of stud 190 and panel 192 assembly. As with the previously disclosed embodiment, an insulating layer 194 is applied to a selected face of the panel 192 and a corresponding edge of the panel seats within a selected notch or recess 196 arranged in axial extending fashion along the stud and opposite recess 198.

A bottom plate 200 is provided and which is typically constructed of a pressure treated (and typically rot-resisting) material. An axial recess 202 extending in communication with a top face of the plate 200 provides for secure alignment and seating of the associated bottom edges (see at 204) of a plurality of panels arranged in end-to-end securing fashion. The bottom plate is preferable used in applications including standard framing (deck) or upon garage and slab floors.

The present invention discloses a more energy efficient, stronger and more versatile construction assembly than is made possible with conventional studs and wall covering members. As further explained, the present invention is capable of being constructed in a wide variety of different wall, ceiling, floor and truss applications. Additional features and advantages include the ability to provide one recyclable component for building the roof, floor and wall of a structure, and with corresponding decreases in waste materials. The present invention is further not limited by dimensions or materials.

Having described my invention, other and additional preferred embodiments will become apparent to those skilled in the art to which it pertains and without deviating from the scope of the appended claims.

I claim:

1. A multi-functional building assembly, comprising:

an elongated stud, said stud including at least one polygonal shaped notch defined in axially extending fashion alone at least one extending surface thereof;

an elongated planar shaped panel, said panel including at least one extending edge which matches in configuration that of said notch and in order that said panel is secured to said stud; and a floor supporting hanger for securing a bottom extending edge of said panel, a side extending edge of said hanger seated between succeeding layers of a plywood sheeting and an extending bond support member, a curled and substantially "U" shaped edge extending from said side extending edge in turn supporting said bottom extending edge of said panel.

2. The building assembly as described in claim 1, said notch further comprising a substantially "V" shaped notch, said stud further comprising first and second notches arranged in oppositely extending fashion along associated oppositely extending surfaces of said stud.

3. The building assembly as described in claim 1, further comprising a plurality of studs and panels engaged in end-to-end extending fashion to construct a wall.

4. The building assembly as described in claim 1, further comprising a plurality of studs and panels being interengaged to construct a corner and wall detail.

5. The building assembly as described in claim 1, further comprising an extending two inch by two inch cross sectional dimensional portion associated with said stud providing a floor joist board support.

6. The building assembly as described in claim 1, further comprising a bottom plate for supporting a corresponding bottom extending edge of said elongated shaped panel.

7. The building assembly as described in claim 1, further comprising an insulating layer applied to an outer face of said planar shaped panel.

8. The building assembly as described in claim 7, said insulating layer further comprising a laminated rigid foam.

9. The building assembly as described in claim 4, further comprising a vertically extending nailer board corresponding to a corner edge location of said assembly.

10. The building assembly as described in claim 3, further comprising a header and support and mating frame securing over a rectangular shaped aperture formed in selected stud and panel members, and in order to provide for at least one of a window and door frame.

11. The building assembly as described in claim 1, said notch further comprising a substantially "square" shaped notch, said stud further comprising first and second notches arranged in oppositely extending fashion along associated oppositely extending surfaces of said stud.

12. The building assembly as described in claim 3, further comprising an elongate extending and "U" shaped base nailer, extending ends of said studs being seated w thin said base nailer.

13. The building assembly as described 4, further comprising an "X" cross sectional shaped corner backer, applied against inside corners of said stud and for providing a support edge for securing such as a drywall sheet edge.

14. The building assembly as described in claim 1, further comprising a multi-story building wall configuration employing two inch by six inch cross sectional dimensioned and two inch by four inch cross sectional dimensioned stud and panel arrangements in stacked fashion, a plurality of vertically extending and heat distribution channels and vents extending along said stacked studs and panels.

15. A multi-functional building assembly, comprising:

a plurality of elongated studs, each of said studs including a recessed notch defined in axially extending fashion along each of first and second opposite extending side edge surfaces thereof;

a plurality of elongated and planar shaped panels, said panels each including at least one extending edge which matches in configuration that of said notch and in order that a selected panel is secured to a selected stud;

a plurality of said studs and panels being engaged in end-to-end extending fashion to construct at least one of a wall and a corner detail; and an elongated base nailer having at least one of an "L" shape and a "U" shape cross section for securing bottom ends of said studs and panels.

16. The building assembly as described in claim 15, further comprising an insulating layer applied to at least one of inner and outer facing surfaces associated with each of said planar shaped panels.

17. The building assembly as described in claim 15, further comprising a header and support and mating frame securing over a rectangular shaped aperture formed in selected stud and panel members, and in order to provide for at least one of a window and door frame.

18. A multi-functional building assembly, comprising:

a plurality of elongated studs, each of said studs including a recessed notch defined in axially extending fashion along at least one of first and second opposite extending side edge surfaces thereof;

a plurality of elongated and planar shaped panels, said panels each including at least one extending edge which matches in configuration that of said notch and in order that a selected panel is secured to a selected stud;

a plurality of said studs and panels being engaged in end-to-end extending fashion to construct at least one of a wall and a corner detail;

a bottom plate for supporting corresponding bottom extending edges of said elongated shaped panels, said bottom plate exhibiting at least one of an "L" shape and a "U" shape cross section; and a floor supporting hanger for securing a bottom extending edge of said panels.

* * * * *

UNITED STATES PATENT AND TRADEMARK OFFICE

CERTIFICATE OF CORRECTION

PATENT NO. : 7,373,762 B2
APPLICATION NO. : 10/840523
DATED : May 20, 2008
INVENTOR(S) : Richard L. Hubbard It is certified that error appears in the above-identified patent and that said Letters Patent is hereby corrected as shown below:

Column 1, line 32, delete “is”

Column 4, line 55, replace “dry wall” with --drywall--

Column 5, line 34, replace “into wall” with --into a wall--

Signed and Sealed this

Twelfth Day of August, 2008

JON W. DUDAS
*Director of the United States Patent and Trademark Office*